United States Patent [19]

Kennedy et al.

[11] 4,387,580

[45] Jun. 14, 1983

[54] AUTOMATIC WASHER ENERGY ABSORBING SPIN DELAY MECHANISM

[75] Inventors: William L. Kennedy, Coloma Township, Berrien County; Richard L. Fanson, St. Joseph Township, Berrien County, both of Mich.

[73] Assignee: Whirlpool Corporation, Benton Harbon, Mich.

[21] Appl. No.: 218,039

[22] Filed: Dec. 19, 1980

[51] Int. Cl.[3] ..... D06F 37/40

[52] U.S. Cl. ..... 68/12 R; 68/23.7; 192/46

[58] Field of Search ..... 68/12 R, 23.6, 23.7; 192/46; 64/27 L

[56] References Cited

U.S. PATENT DOCUMENTS

| | | | |
|---|---|---|---|
| 2,583,168 | 1/1952 | Fields | 68/23.6 |
| 3,340,972 | 9/1967 | Burkland et al. | 192/46 X |
| 3,990,554 | 11/1976 | Lowery | 192/26 |
| 4,218,899 | 8/1980 | Mason | 68/12 R |

*Primary Examiner*—Philip R. Coe

*Attorney, Agent, or Firm*—Hill, Van Santen, Steadman, Chiara & Simpson

[57] ABSTRACT

An improved delay mechanism for providing a delay in the spin cycle of an automatic washer is operated by means of a resilient spring driver pivotable about a stud rotating on an eccentric, which in turn is engageable with a spin gear only in one direction of rotation, and thereby provides a delay of substantially one revolution of the eccentric upon a change in direction of rotation of the eccentric.

7 Claims, 6 Drawing Figures

AUTOMATIC WASHER ENERGY ABSORBING SPIN DELAY MECHANISM

BACKGROUND OF THE INVENTION

1. Field of the Invention

The present invention relates generally to automatic washing machines and more particularly to drive mechanisms therefor.

2. Description of the Prior Art

Many laundry appliances operate automatically through a programmed cycle consisting of various washing, rinsing and drying cycles. During the wash portion, agitator means are actuated in a treatment zone to flex the clothes in the presence of a laundry liquid. Upon the completion of the wash portion, the water is drained from the wash basket and the basket may be corotated with the agitator at a high speed to centrifugally remove laundry liquid or rinse water from the clothes.

U.S. Pat. No. 4,218,899 describes a delay mechanism for providing a delay in the spin cycle of an automatic washer operated by means of a rigid pawl pivotable about a stud rotating on an eccentric, which in turn is engageable with a spin gear only in one direction of rotation, and thereby provides a delay of substantially one revolution of the eccentric upon a change in direction of rotation of the eccentric.

SUMMARY OF THE INVENTION

An automatic washer having a single motor and drive mechanism to operate a vertical axis agitator and a clothes basket during washing and drying portions of a complete cycle includes a rack and pinion means to translate rotational movement of the motor to oscillatory movement of the agitator during the wash portion of the cycle. The oscillatory means must then be disengaged by means of a jaw clutch so that it is free to rotate with the basket at high speed during a spin portion of the cycle. The jaw clutch is provided to cause engagement and disengagement of the oscillatory means with the agitator upon a change in direction of rotation of the motor. The disengagement means requires one complete rotation of a drive gear to insure complete disengagement.

In accordance with the present invention, a minimum delay of substantially one revolution of the drive gear is provided to insure that rapid spinning of the basket does not begin prior to disengagement of the oscillatory means.

More specifically a spin gear engaged with the basket has an annular channel on a lower surface thereof. The gear is mounted on a jack shaft parallel to the agitator shaft, the jack shaft also having mounted thereon a separately rotatable eccentric.

The present invention utilizes an engagement spring driver means having a substantially circular arc shape of less than 360° with a gap therein defining first and second ends, the engagement means having its first end pivotally mounted on the eccentric so as to rotate or otherwise move the engagement means inside the annular channel in the spin gear. The outer wall of the annular channel in the spin gear has a surface extending radially inwardly therefrom. In one direction of rotation, the second or free end of the spring repeatedly passes the surface without engagement therewith. Upon a change in the direction of rotation of the spring to a second opposite direction, the second or free end of the spring is urged radially outwardly and an abutment surface thereon is caused to engage the radially inwardly extending surface. As the abutment surface on the second end engages the radially inwardly extending surface, the second end is urged toward the first end of the spring closing the gap therebetween and steadily accelerating the spin gear so as to corotate with the rotating eccentric.

As in U.S. Pat. No. 4,218,899, the means to move the spring into or out of engagement with the inwardly extending surface includes a lever frictionally coupled to an interior hub of the channel in the spin gear, thus requiring the spring to rotate substantially one revolution upon a change to the second direction of rotation before the lever moves the spring into a position for engagement with the surface. Thus, the requisite delay of one revolution of the drive gear is provided.

The accelerating engagement between the spin gear and the eccentric provides several advantages. First, stress on the connecting parts, that is the spring and the inwardly extending surface, is reduced providing for a longer life for the parts. Second, the cushioning nature of the resilient spring reduces the impact noise caused by the engagement between the spring and the inwardly extending surface.

DESCRIPTION OF THE PREFERRED EMBODIMENTS

Figure 1:
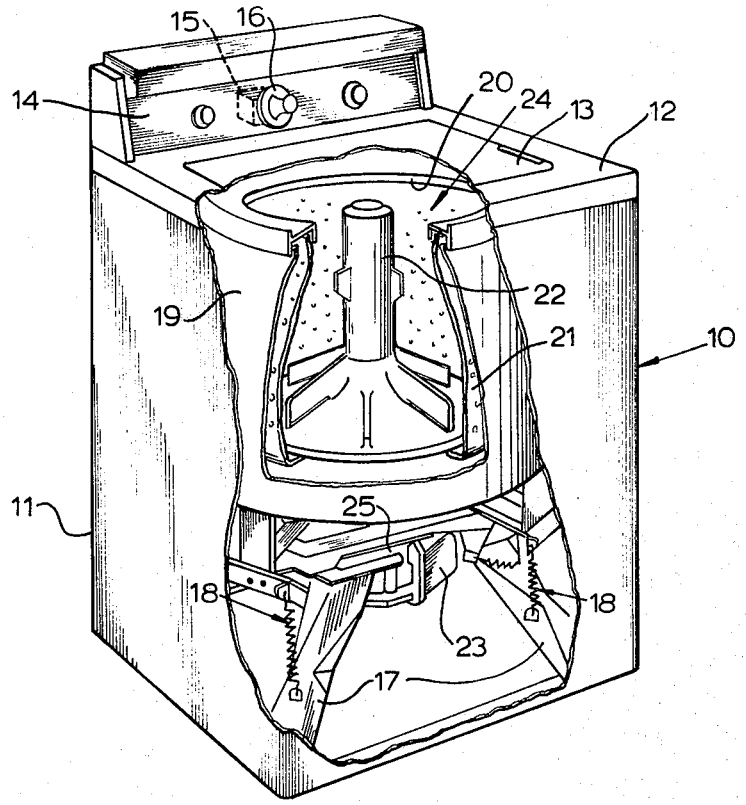
FIG. 1 is a perspective view, partly broken away, of an automatic laundry appliance embodying the present invention.

An automatic laundry appliance is generally illustrated in FIG. 1 at 10 and comprises a tub 19 which has a perforated clothes container or spin basket 21 contained therein and an agitator 22 disposed within the spin basket 21 and mounted for oscillatory movement with respect thereto on a vertical axis. The basket 21 is mounted for spinning movement during centrifugal extraction of water from the clothes within the basket 21. The tub 19, the spin basket 21, the agitator 22 and a drive mechanism 23 therefor are contained in a cabinet 11.

The cabinet 11 has a top 12 having a hinged lid 13 which is opened to afford access to a clothes-receiving opening 24 defined by a tub ring 20 extending about the tub 19 and circumscribing a corresponding opening in the spin basket 21. The cabinet 11 also houses a presettable sequential control means 15, generally comprising a timer having a timer dial 16 connected thereto and mounted on a control panel portion 14 of the cabinet 11. The timer dial 16 and the control means 15 may be mounted in any desired location. Suitable wiring connects the control means 15 to a prime mover motor of the drive mechanism 23 and to other electrical components of the appliance as is well known in the art.

The control 15 provides automatic operation of the appliance 10 through a pre-set sequence or program of operation including a wash or agitate period wherein the agitator 22 is oscillated to agitate a clothes load contained in basket 21 followed by a spin or dry period wherein the basket 21 is rotated to centrifuge wash liquid from the clothes load while the agitator is freed from oscillation to rotate with the basket. All components inside the cabinet 11 are supported by struts 17, having a suspension system 18 connected thereto to minimize vibration.

Figure 2:
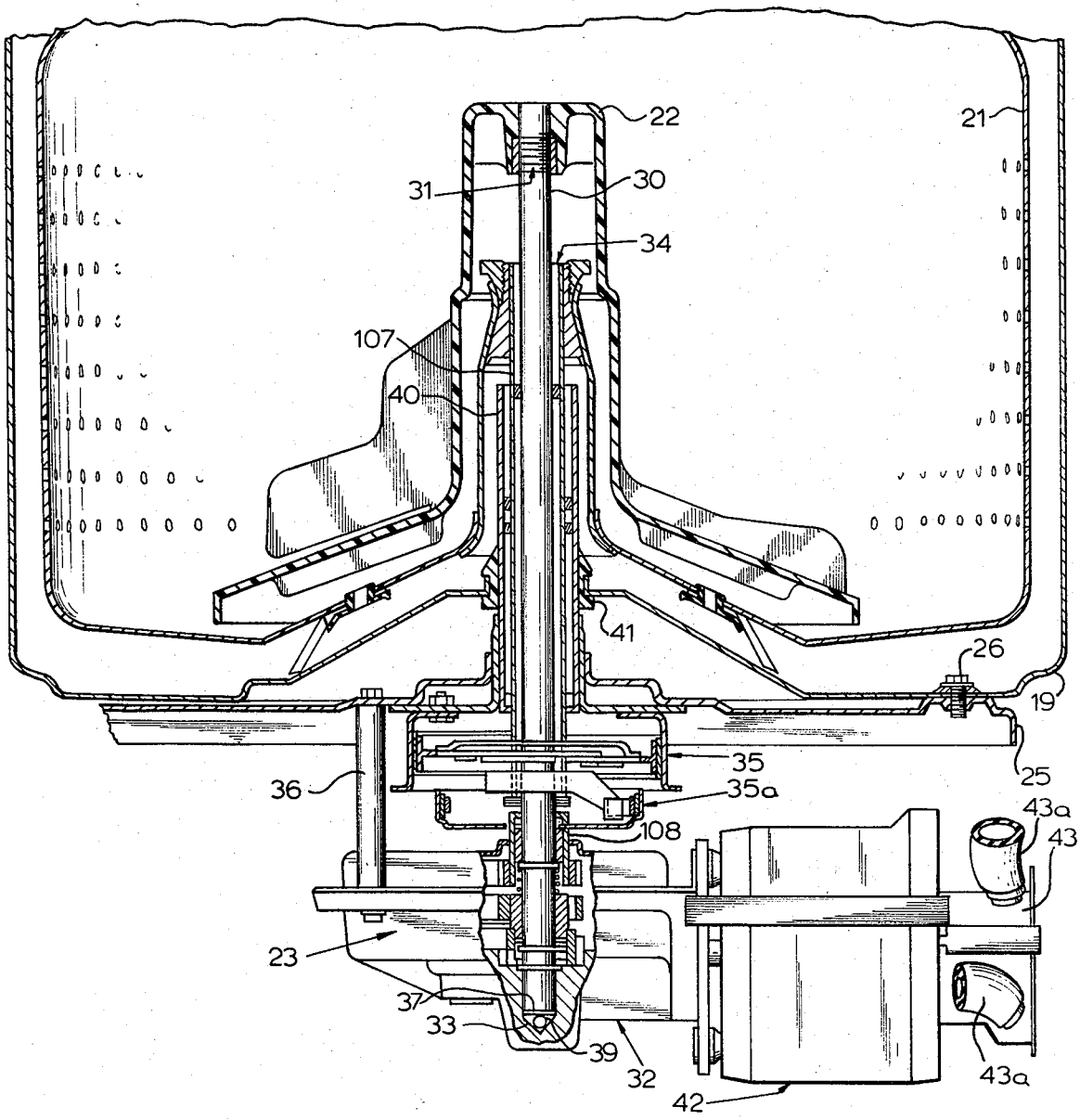
FIG. 2 is an enlarged cross-sectional view of the tub and transmission housing of FIG. 1.

The drive mechanism 23 also operates a pump 43 (FIG. 2) used for recirculating laundry liquid and for draining the tub 19 and basket 21 of laundry liquid. The drive mechanism 23, including components such as a transmission housing 32 and a motor housing 42, as shown in FIG. 2, is suspended from a mounting plate 25 by mounting means 36 such as a bolt and sleeve arrangement. Portions of hoses **43*a*, associated with the pump 43, are also illustrated in FIG. 2. The tub 19 is also mounted to the mounting plate 25 by means of bolts such as 26. A grommet 41 maintains a water-tight relation between the tub 19 and a spin tube encasement column 40. A constant torque clutch means 35*a* and a brake means 35 are also provided to operate in association with the spin tube 107, and are mounted between the mounting plate 25 and the transmission housing 32**.

The agitator 22 is attached to an agitator shaft 30 by a nut and threaded shaft portion attachment means 31 and the spin basket 21 is attached to the spin tube 107 by a drive block attachment means 34. The shaft 30 is received at its lower end in a receptacle 33 in the housing 32 and rotates on a bearing 39 having a bearing surface 37.

Figure 3:
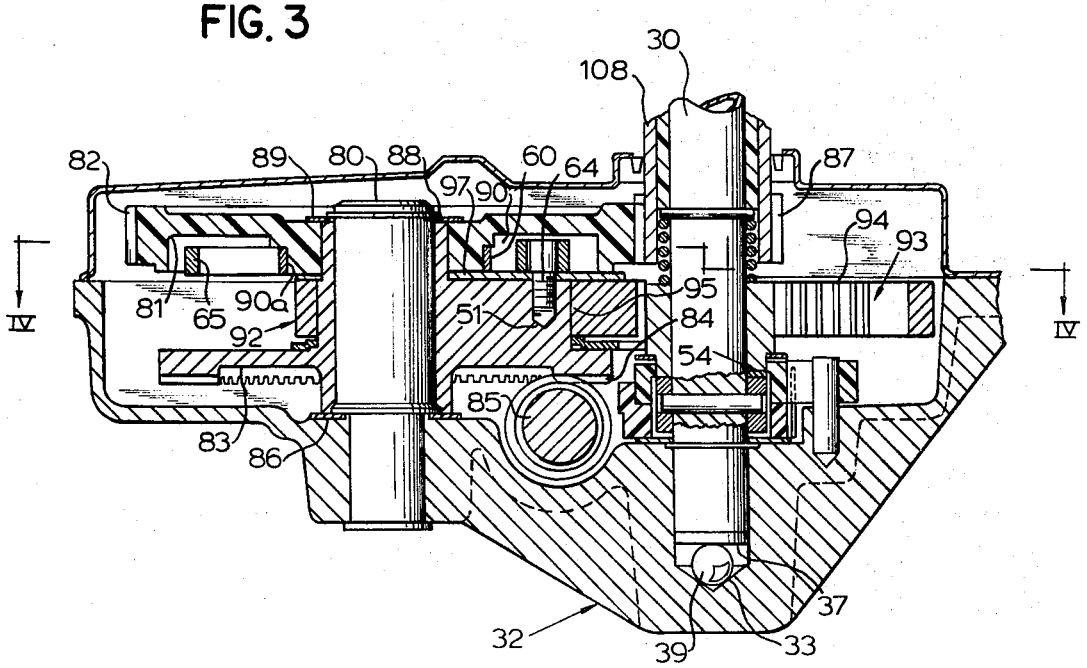
FIG. 3 is an enlarged sectional view of the clutch and spin delay mechanism in the transmission housing shown in FIG. 2.
Figure 4:
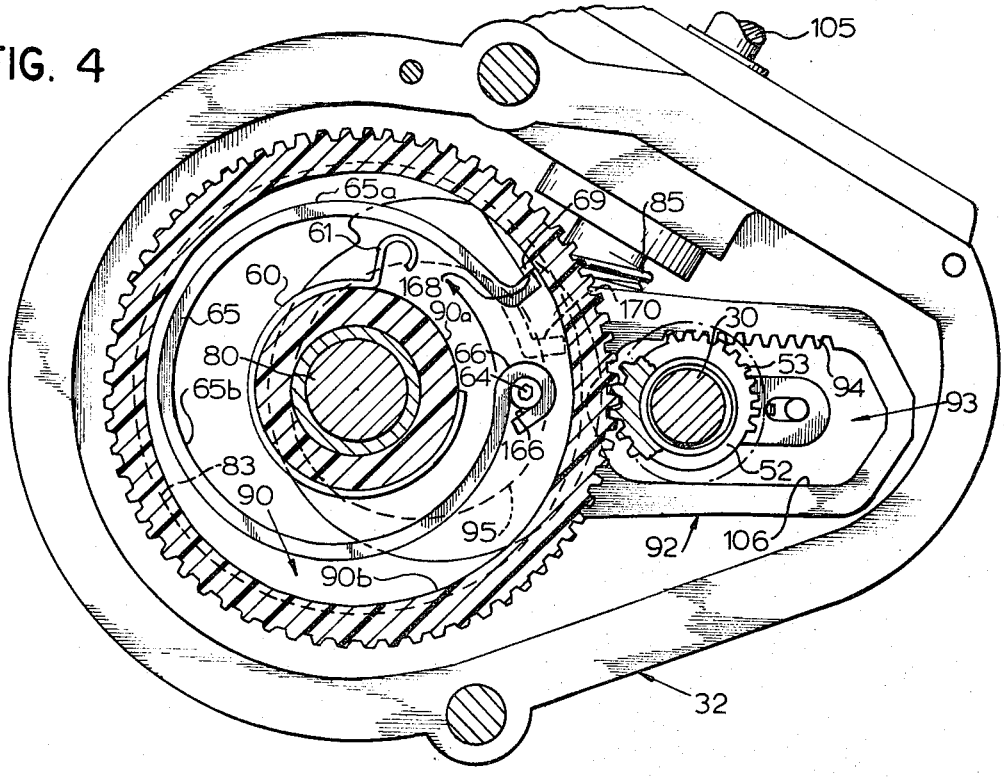
FIG. 4 is a section view, partly broken away, taken along line IV—IV of FIG. 3, showing operation during counterclockwise rotation of the main drive gear.
Figure 5:
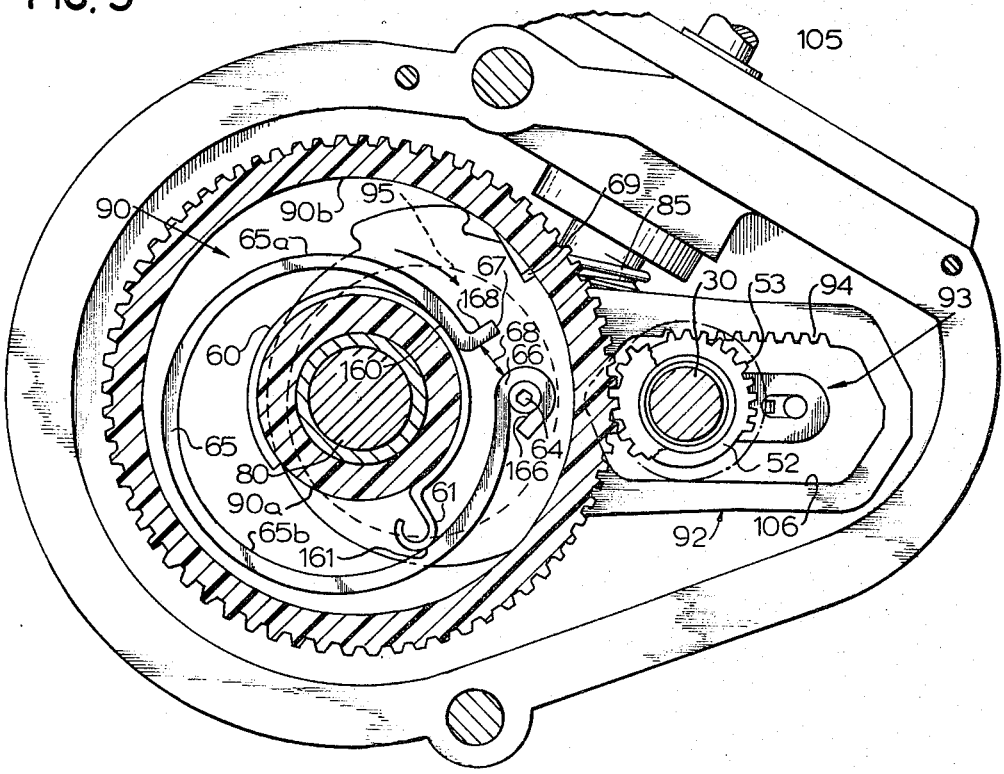
FIG. 5 is a sectional view, partly broken away, taken along line IV—IV of FIG. 3, showing operation during clockwise rotation of the main drive gear.

Referring to FIGS. 3, 4 and 5, a worm gear 85 is carried on one end of a drive shaft 105, the other end of which is connected to the prime mover motor housed in the housing 42 (FIG. 2). The worm gear 85 engages teeth 84 disposed circumferentially on a lower surface of a main drive gear 83. The drive gear 83 is rotatably mounted on a jack shaft 80 and rides against a bearing washer 86. An upper portion of the drive gear 83 has an eccentric 95 integrally formed thereon. One end of a rack 92 has an opening for receiving the eccentric and operates in slidable movement therewith. A bearing plate 97 is positioned above the rack 92 on the eccentric 95 and held in place by a stud 64 which is received in a receptacle 51 in the eccentric 95. Mounted above the bearing plate 97 and concentric with drive gear 83 is a spin gear 81 having teeth 82 which engage teeth 87 on a spin pinion 108 rotatable about agitator shaft 30 and which is selectively coupled by the constant torque clutch means **35*a* and the brake means 35 to the spin tube 107 as shown in FIG. 2. All elements mounted on the jack shaft 80 are maintained in adjacent relation by a cover plate 89 which is held in place by a snap ring 88**.

An opposite end of the rack 92 has a loop 93 which surrounds agitator shaft 30. A row of teeth 94 are formed on one side of the loop 93 and engage teeth 53 formed on a portion of the exterior of an agitate pinion 52 rotatably mounted about the agitator shaft 30. The side of the loop 93 opposite the teeth 94 has a smooth bearing surface 106 movable against a portion of the exterior of the pinion 52 having no teeth thereon, thereby insuring complete engagement of the teeth 53 on the agitate pinion and the teeth 94 on the rack. As the eccentric 95 is rotated by the main drive gear 83, a reciprocal motion in a plane normal to the agitator shaft 30 is imparted to the rack 92. This reciprocatory motion is transferred to the agitate pinion 52 by means of engagement of the teeth 94 and 53, causing an oscillatory motion in the agitate pinion. This oscillatory motion is then transferred to the agitator shaft 30 through a jaw clutch 54 (FIG. 2) not shown in detail herein, but shown and described in detail in U.S. Pat. No. 4,218,899, the disclosure of which is incorporated herein by reference.

For purposes of the present invention, it is necessary to understand only that the jaw clutch means is used to drive the agitator in an oscillatory manner and must be completely disengaged prior to rotation of the spin basket 21 by means of the spin gear 81. To insure complete disengagement of the jaw clutch means as described in the referenced patent, a delay of a period of substantially one rotation of the eccentric 95 must be accomplished prior to rotation of the spin gear 81. It is important to prevent rotation of the spin basket 21 while the agitator is still being driven in an oscillatory manner because the operation of both the agitator and the spin basket at the same time can cause overloading of the motor, overstressing of other parts in the drive system, or damage to a clothes load within the basket.

Figure 6:
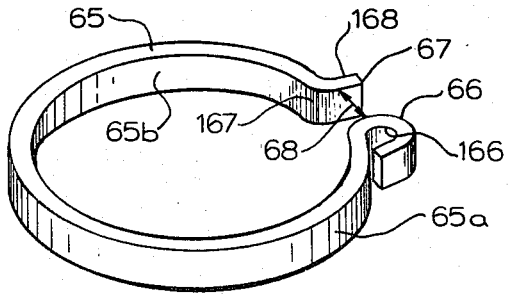
FIG. 6 is a perspective view of the engagement spring driver shown in FIGS. 3, 4 and 5.

Referring to FIGS. 3, 4 and 5, this delay is effected by a delay mechanism including a resilient spring driver 65 (shown in FIG. 6) having an outer surface **65*a* and an inner surface 65*b*. The spring driver 65 is pivotally mounted on the stud 64. The spring driver has a substantially circular arc shape of less than 360° with a gap 68 therein defining a first end 66 and a second or free end 67**.

The first end 66 of the spring driver 65 is formed to have an eye 166 therein such that the eye 166 may be rotatably mounted on the stud 64. The free end 67 of the spring driver 65 is bent as at 167 so as to form an abutment surface 168 generally perpendicular to the outer surface **65*a* of the spring driver 65 at 167**.

An actuator clip 60 having a radially outwardly extending tang 61 is fitted around an inner wall **90*a* of an annular channel 90 formed in the lower side of the spin gear 81. The tang 61 extends outwardly to be in contact with the inner surface 65*b* of the spring driver 65**.

When the main gear 83 rotates in a clockwise or agitate direction (FIG. 5) the spring driver 65 is rotated with respect to the tang 61 of the actuator clip 60 such that the tang 61 acts as a cam and continuously urges the portion of the spring driver 65 adjacent the tang 61 outwardly from the inner wall **90*a* of the annular channel 90 in the spin gear 81. As the rotation of the spring driver 65 progresses, the tang 61 is wedged between the inner wall 90*a* and the inner surface 65*b* of the spring driver 65 as at 161. When the tang 61 wedges into position at 161, there is sufficient force to cause the clip 60 to slip on the wall 90*a* and thus corotate with the spring driver 65**.

The camming effect of the tang 61 rotates the spring driver 65 about the stud 64 and causes the second or free end 67 to move toward the clip 60 and the wall **90*a* until it abuts the clip 60 at 160 when the tang 61 wedges at 161. A clearance is therefore maintained between the abutment surface 168 of the spring driver 65 and a radially inwardly extending surface 69 carried on an outer wall 90*b* of the annular channel 90. Thus, the main gear 83 rotates freely beneath the spin gear 81 while the spring driver 65 rotates the clip 60 on the wall 90***a* and the spin gear remains stationary.

When rotation of the main gear 83 is reversed to a counterclockwise or spin direction (FIG. 4), by means of sequential control means 15 reversing the direction of rotation of the motor, the integral eccentric 95 on the main gear 83 will also be rotated in the counterclockwise direction. When rotating in this direction, the spring driver 65 rotates with respect to the clip 60 and out of the wedged connection with the tang 61. The tang 61 cams against the inner surface 65*b* of the spring driver 65 as it rotates toward the second or free end 67 until the free end 67 contacts the outer wall 90*b* of the annular channel 90. As the eccentric 95 continues to turn, the flat abutment surface 168 is rotated into contact or coupled to the inwardly extending surface 69 causing corotation of the spin gear 81 with the eccentric 95. The rotational movement of the main gear 83 will thus be transferred to the spin gear 81 so that the two gears rotate together.

As the abutment surface 168 impacts against the radially inwardly extending surface 69, the free end 67 of the spring driver 65 is urged toward the first end 66 as at 170, thus closing the gap 68 therebetween. The spring driver 65 is constructed to be sufficiently stiff such that the spin gear will be accelerated before the second end 67 and the first end 66 contact. Thus, the stress on the components such as the spring driver 65 and the inwardly extending surface 69 will be cushioned and reduced in that the spin gear will be accelerated to full rotational speed over a short period of time rather than instantaneously. Additionally, the impact noise between the spring driver 65 and the inwardly extending surface 69 will be reduced.

Depending upon the position of the second end 67 of the spring driver 65 with respect to the inwardly extending surface 69 when the direction of the motor is reversed to the spin direction, the delay between reversal and the time at which surface 67 begins to drive against surface 69 will be between substantially one revolution and substantially two revolutions of the main drive gear 83. One revolution delay is effected when the abutment surface 168 of the second end 67 is immediately in contact with the surface 69 upon contact with tang 61. Substantially two revolutions of delay occur when the abutment surface 168 is just past surface 69 upon contact with tang 61 and the surface 168 must therefor travel one further revolution against wall 90*b* before contacting surface 69. Thus, engagement of the abutting surface 168 and 69 cannot occur until at least substantially one complete revolution of the main drive gear 83 has resulted after the change in direction of the main drive gear 83 when the control means 15 signals a spin period following an agitate period. It is thus insured that a delay of at least one rotation of the spin gear 81 will result before the spin gear 81 begins to rotate the basket 21 to insure that the agitate jaw clutch is disengaged before the basket begins to spin.

Various changes and modifications of the invention may be apparent to those skilled in the art, however, it is the intention of the applicants to embody within the patent warranted hereon all such changes and modifications as may reasonably and properly be included within the scope of the applicants' contribution to the art.

The embodiments of the invention in which an exclusive property or privilege is claimed are defined as follows:

1. In an automatic laundry appliance having, a rotatable clothes receptacle, a vertical agitator within said receptacle, a reversible motor and associated drive means for driving said agitator in oscillatory motion and said receptacle in rotary motion, a control means controlling a cycle of operation including a period of driving said agitator and a period of driving said receptacle, and a coupling means having a main drive gear driven by said motor included in said drive means; the improvement comprising an automatically actuated resilient engagement means mounted on said drive gear to selectively corotate a second drive gear with said main drive gear, said second drive gear having a first abutment surface, and said engagement means comprised of a spring having a substantially circular shape with a gap therein defining a first end and a second end, said first end rotatably mounted on said main drive gear, and said second end having a second abutment means for selectively engaging said first abutment surface said engagement means having a first position disengaging said gears and a second position engaging said gears; and a delay means for moving said engagement means from said first position to said second position after a delay of substantially one revolution of said main drive gear, whereby a beginning of said receptacle rotary motion is delayed said one revolution after said oscillatory motion of said agitator has ended.

2. The appliance of claim 1, wherein said engagement means is rotatably mounted on said drive gear.

3. The appliance of claim 1, wherein said delay means is a tang corotatable with said second drive gear which moves said engagement means to engage said gears after a reverse in direction of rotation of said motor.

4. In an automatic appliance including, a rotatable clothes receptacle, a vertical agitator within said receptacle, a reversible drive motor and associated drive means for driving said agitator in oscillatory motion and said receptacle in rotary motion, and a coupling means included in said drive means, said coupling means comprising:

a main drive gear driven by said motor, an eccentric mounted on said main drive gear, a rack and pinion operated by said eccentric for engaging said main drive gear with said agitator for transmission of oscillatory motion to said agitator, a clutch means controlled by said eccentric for engaging and disengaging said main drive gear and said agitator, said clutch means having a shifter fork selectively engageable with a cam member when said eccentric is rotated in a first direction, and a second drive gear for driving said receptacle in rotary motion, said second drive gear mounted coaxially with said main drive gear and having an annular channel in a bottom surface thereof and a first abutment surface extending a distance radially inwardly from an outward wall of said channel;

the improvement of a resilient engagement means comprising a spring having a substantially circular shape with a gap therein defining a first end and a second end, said first end pivotally mounted on said eccentric for rotation therewith, said second end having a second abutment surface means for selectively engaging said first abutment surface, an actuator means frictionally coupled to an interior hub of said second drive gear, said hub forming an inner wall of said channel, said actuator means being in contact with an interior wall of said circular engagement spring such that during rotation of said eccentric in said first direction said actuator means moves said second end of said spring having said second abutment surface out of engagement with said first abutment surface of said second drive gear, and during rotation of said eccentric in an opposite direction of rotation said actuator means moves said second end of said lever having said second abutment surface thereon into engagement with said first abutment surface of said second drive gear causing corotation of said second drive gear with said main drive gear, and said circular shape of said engagement spring having a diameter such that substantially one revolution of said eccentric must occur before said actuator means moves said second abutment surface into engagement with said first abutment surface.

5. In an automatic laundry appliance being a clothes washer of the type including first and second drive means having a cycle of operation controlled by a presettable sequential control means and a delay means for delaying coupling of said second drive means until said first drive means is completely decoupled, the improvement of, a driver comprising a generally circular shaped open loop made of resilient material and having an eye formed at one end thereof for pivotal mounting on a stud formed on a main drive gear and having an offset shoulder formed at the opposite end thereof providing an abutment surface means for selective engagement with a driven spin gear of said second drive means, said driver operating to engage said main drive gear and said driven gear with a cushioning action to absorb stress and reduce noise.

6. The appliance of claim 5, including an eccentric mounted on said main drive gear, a rack and pinion operable by said eccentric for transmitting oscillatory motion to said agitator and a clutch for engaging and disengaging said pinion and said agitator.

7. The appliance of claim 4, including a presettable sequential control means for controlling a cycle of operation including a period when said main drive gear is disengaged followed by a period when said second drive gear is engaged to said motor.

* * * * *